US005967851A

United States Patent [19]

Ozer et al.

[11] Patent Number: 5,967,851

[45] Date of Patent: Oct. 19, 1999

[54] CIGARETTE LIGHTER ADAPTER HAVING PLUNGER RETENTION MECHANISM

[75] Inventors: Yaacov Ozer; Josef Winner; Levi Sales, all of Hong Kong, China

[73] Assignee: Rosslare Enterprises, Ltd., Kowloon, The Hong Kong Special Administrative Region of the People's Republic of China

[21] Appl. No.: 09/137,725

[22] Filed: Aug. 21, 1998

[51] Int. Cl.[6] ..... H01R 17/18

[52] U.S. Cl. ..... 439/668; 439/622

[58] Field of Search ..... 439/668, 669, 439/344, 621, 622, 700, 824

[56] References Cited

U.S. PATENT DOCUMENTS 3,116,386 12/1963 Sperzel ..... 439/621

5,158,484 10/1992 Chou ..... 439/668

*Primary Examiner*—Steven L. Stephan
*Assistant Examiner*—Javaid Nasri
*Attorney, Agent, or Firm*—Loeb & Loeb, LLP

[57] ABSTRACT

A cigarette lighter adapter for use in a cigarette lighter adapter assembly enables use of a cellular phone while driving in an automobile. By plugging the adapter into a car cigarette lighter, power is provided from the car battery to the cell phone. The adapter includes a plunger retention mechanism for insuring that a metal contact plunger of the adapter is not lost while replacing or checking a fuse in the adapter. In a preferred aspect of the invention, the adapter further includes a force-absorbing element to prevent force from being accidentally applied to the plunger retention mechanism by the metal contact plunger not only while the adapter is assembled and in use, but also should the adapter be accidentally dropped and unforeseen force applied to the plunger.

5 Claims, 4 Drawing Sheets

CIGARETTE LIGHTER ADAPTER HAVING PLUNGER RETENTION MECHANISM

BACKGROUND OF THE INVENTION

1. Field of the Invention

The present invention relates to a cigarette lighter adapter assembly used, for instance, in conjunction with a cellular phone and, more particularly, to a cigarette lighter adapter having a plunger retention mechanism for insuring that the contact plunger of the adapter is not lost while replacing or checking a fuse in the adapter.

2. Description of the Related Art

Cigarette lighter adapter assemblies used, for example, in conjunction with cellular telephones (hereinafter "cell phone") to facilitate use of the cell phone while driving an automobile have proliferated in recent years due to the increasing popularity of cell phones in our car-oriented culture. Such cigarette lighter adapter assemblies provide a power source for cell phones by interconnecting the phone to a car battery through the cigarette lighter.

A conventional cigarette lighter adapter assembly is characterized by three main components, as shown in FIG. 1. Specifically, a cell phone plug 10 and a cigarette lighter adapter 20 are interconnected by means of a power cord 30, preferably a flexible, extendable, coiled power cord. The cell phone plug 10 is adapted to be removably-connected to an input terminal on a conventional cell phone (not shown). Similarly, the cigarette lighter adapter 20 is designed to be removably-connected to a conventional cigarette lighter (not shown).

In operation, power from the car battery is provided to a cell phone through, respectively, the cigarette lighter adapter, power cord and cell phone plug of the assembly. Diverse known preferred features are provided on different adapters. For instance, it is known to provide a cigarette lighter adapter assembly which can charge the cell phone battery, as well as override the phone's battery when the phone is connected to a car battery to amplify or preserve the charge on the cell phone battery.

A typical 12 or 24 V DC cigarette lighter adapter 20 is illustrated in cross-section in FIG. 2. As shown therein, a housing generally indicated at 21 includes main body 22 and apertured cap 23. Cap 23 has a threaded circumferential end 23*a* adapted to be threaded onto a threaded end 22*a* of main body 22. Those of ordinary skill will appreciate that variations on the illustrated assembly are known including, for example, that cap 23 may be externally threaded to mate with female threading on the main body 22. Spring-biased fuse 24, e.g., a 2 A fuse, is removably-situated in the interior of main body 22. Retractable metal plunger 25 having contact element 25*a* and integrally-formed base element 25*b* are removably-situated in cap 23 such that contact element 25*a* extends through aperture 26 in cap 23. When the adapter is inserted into a car cigarette lighter, contact element 25*a* provides a connection to the car battery power source, metal plunger 25 retracts in direction A, and base element 25*b* contacts and depresses fuse 24, thus interconnecting the car battery and a cell phone (not shown) connected to cell phone plug 30 and providing DC power to the cell phone (e.g., 8.2 V; 850 mA).

Between uses, fuse 24 can be checked or replaced by removing cap 23 and extracting fuse 24 by hand. However, this procedure often results in the loss or misplacement of plunger 25, which is loosely and removably-situated in cap 23, thus rendering the adapter unusable. The inconvenience resulting from such a design is manifest and can easily occur at inopportune times, for example, while driving the car.

Accordingly, the need currently exists for a cigarette lighter adapter assembly and adapter which not only achieves its intended function of allowing use of a cell phone from a car, but also minimizes the potential for loss of critical parts and the predictable attendant disadvantages.

SUMMARY OF THE PREFERRED EMBODIMENTS

An object of the present invention is to provide an improved cigarette lighter adapter assembly and adapter for cellular phones and the like.

A further object of the present invention is to provide a cigarette lighter adapter assembly and adapter for cellular phones and the like which minimizes the potential for loss of critical components during routine use and maintenance.

These and other objects are achieved, in accordance with the present invention, by providing a cigarette lighter adapter for a cigarette lighter adapter assembly comprising a housing including a main body for housing a fuse and a cap means removably-secured to the main body, retractable metal plunger means in the cap means for connecting to a car battery power source when the cigarette lighter adapter is engaged with a car cigarette lighter, and plunger retention means in the cap means for retaining the plunger means in the cap means when the cap means is removed from the main body.

In a preferred aspect of the invention, the cap means has an end portion in which the metal plunger means is situated and a threaded portion for removably-connecting the cap means to the main body of the housing, and the plunger retention means comprises a retaining bead formed on an inner surface of the cap means at an interface between the end and threaded portions thereof.

Further in accordance with the present invention, the plunger means comprises a contact end and a flanged base, and the main housing body is provided with force-absorbing means arranged on an end surface of the main body for preventing extraneous force from being applied to the plunger retention means by the plunger means.

BRIEF DESCRIPTION OF THE DRAWINGS

The present invention will now be described and will be better understood in conjunction with the accompanying drawings, in which.

DETAILED DESCRIPTION OF THE PREFERRED EMBODIMENTS

Figure 1:
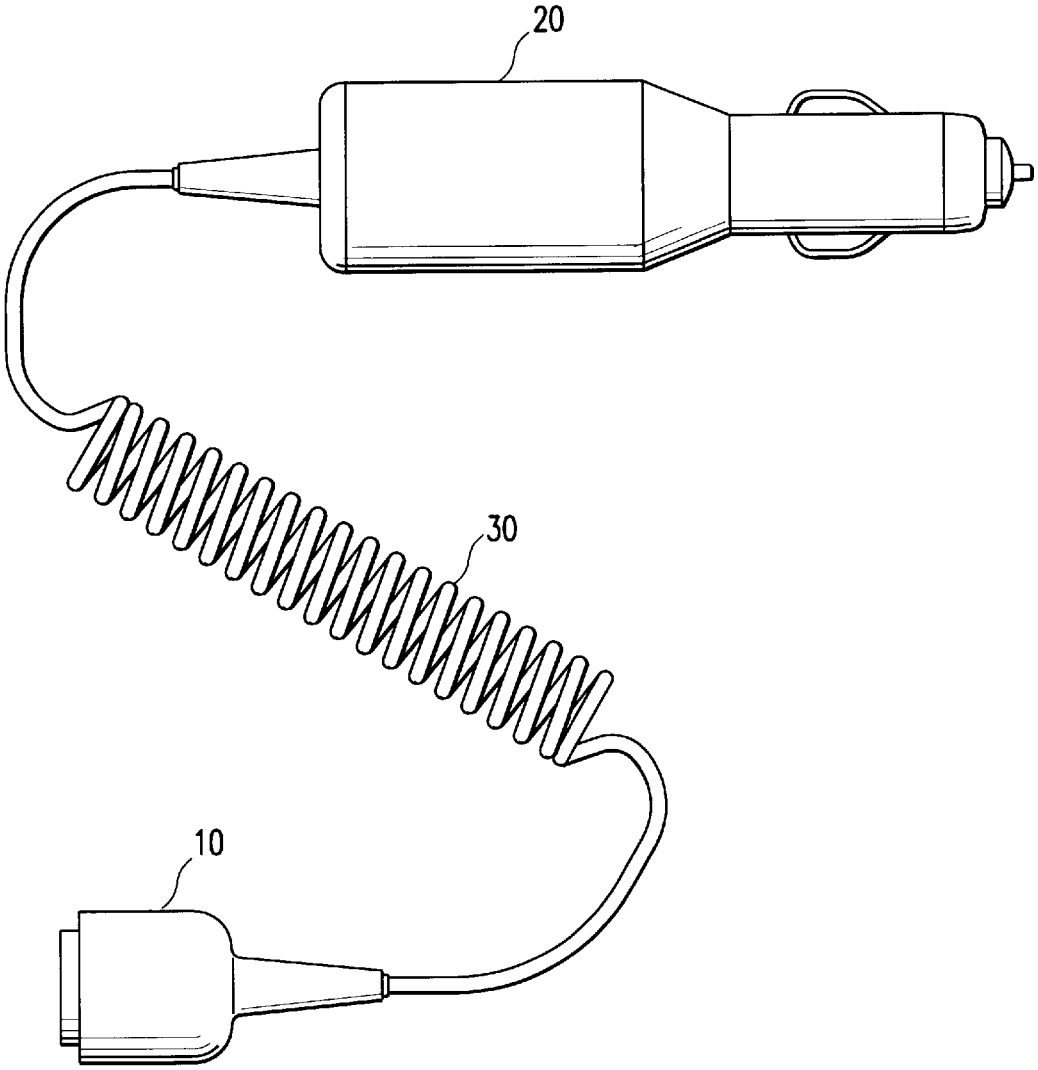
FIG. 1 PRIOR ART
FIG. 1 is a perspective view of a prior art cigarette lighter adapter assembly.
Figure 2:
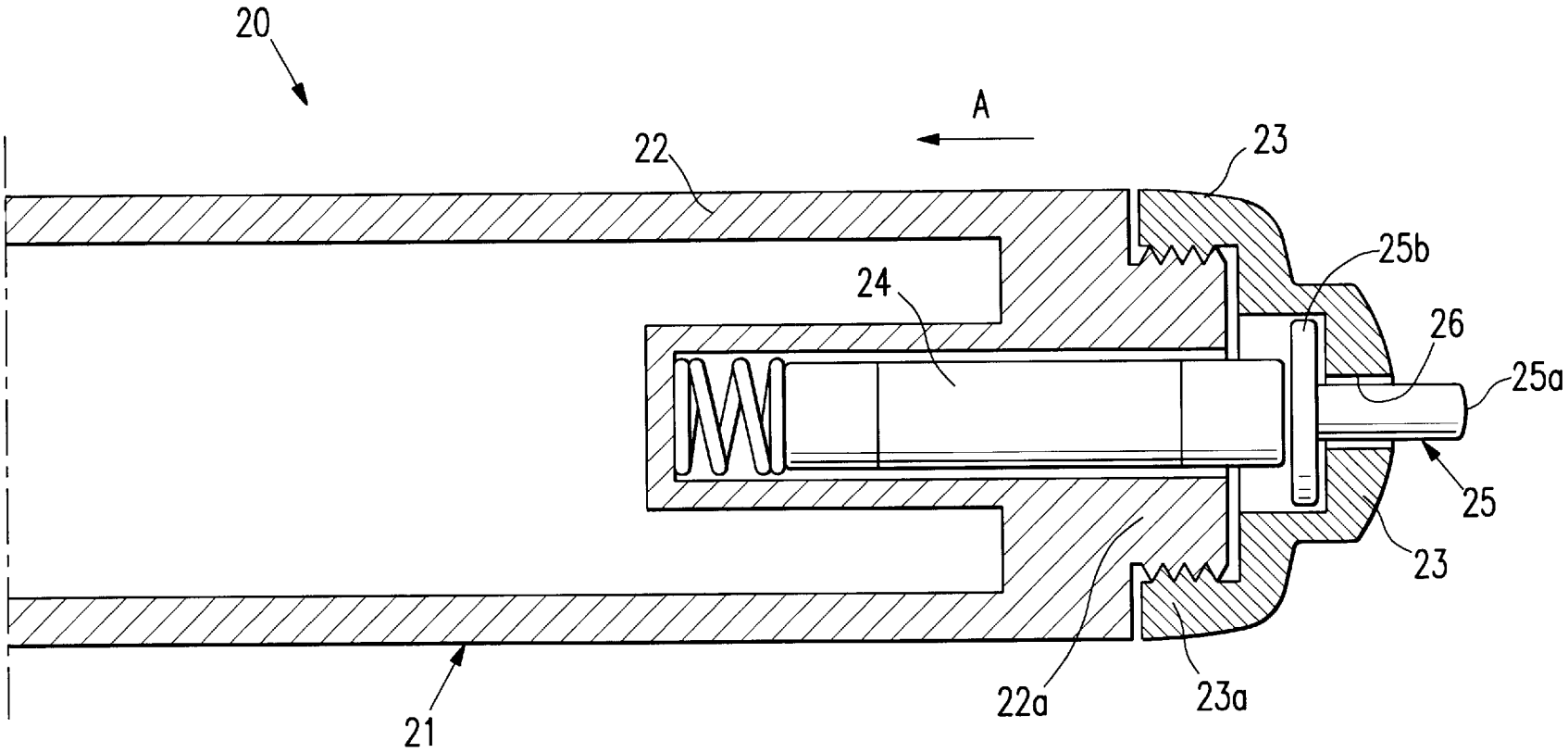
FIG. 2 PRIOR ART
FIG. 2 is a cross-sectional view of the FIG. 1 prior art cigarette lighter adapter 20.
Figure 3:
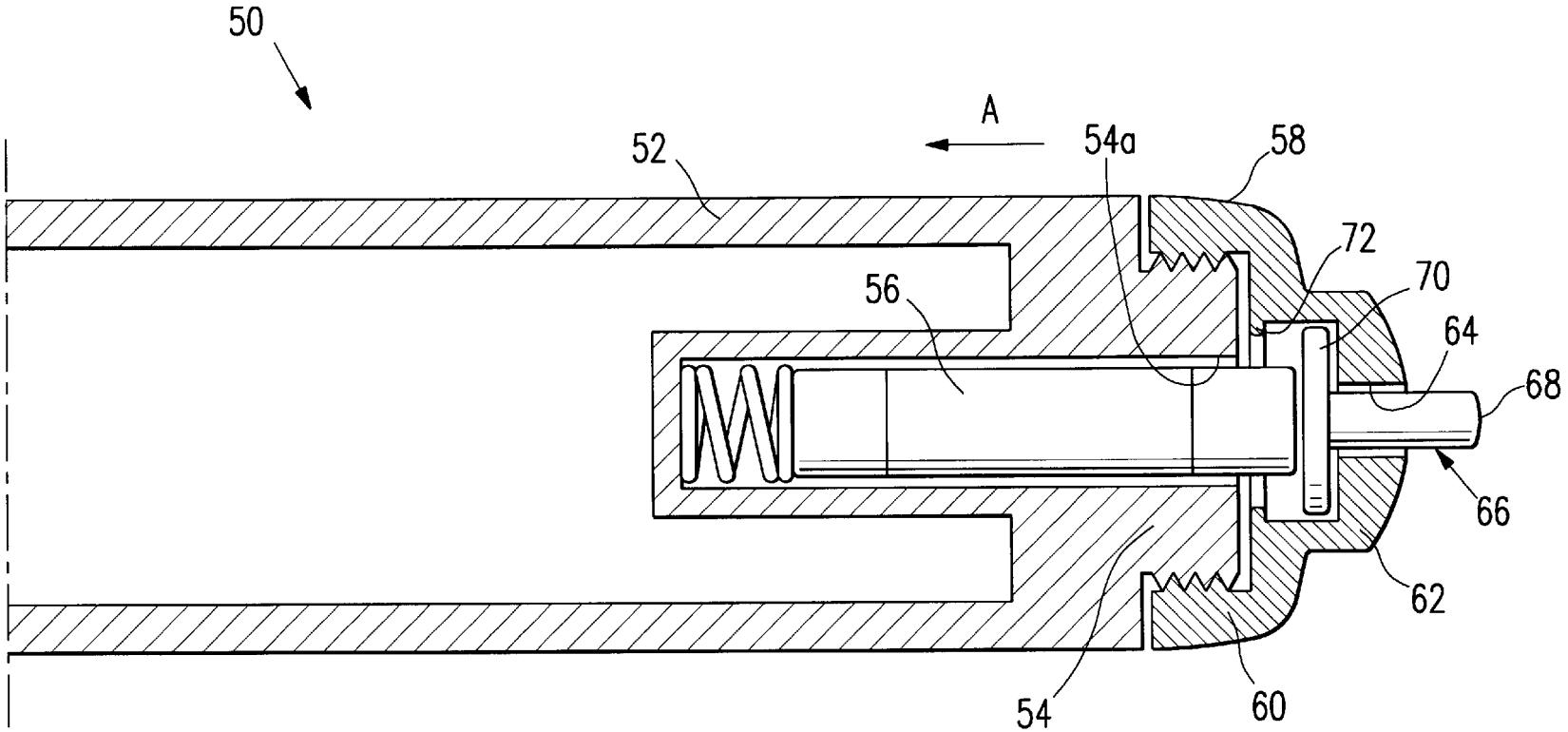
FIG. 3 is a cross-sectional view of a first embodiment of a cigarette lighter adapter in accordance with the present invention.

FIG. 3 is a cross-sectional view of a cigarette lighter adapter made in accordance with the present invention.

As shown in FIG. 3, a cigarette lighter adapter, generally referred to as 50, is connected to a conventional power cord (not shown) which is in turn connected to a conventional cellular phone power plug (not shown), to form a cigarette lighter adapter assembly. The power plug and cord are a conventional 12 or 24 V DC power plug and cord whose particular configuration depends entirely on the particular cell phone it is designed to be used in conjunction with and need not be elaborated on further. In addition, while the present invention is described with reference to a cell phone adapter assembly, it will be readily apparent that the invention could be used in other adapters for coupling the car battery through the cigarette lighter to a device not installed in the car. For example, the present invention might be used with an adapter for providing power to a radar detector, a light, a pump, or any other device which draws power through a cigarette lighter adapter.

Cigarette lighter adapter 50 includes a housing having a main body 52 with a threaded end section 54. The housing is designed to contain a spring-biased removable fuse 56 which extends through aperture 54*a* and slightly out of threaded end section 54. An apertured cap 58 has a threaded circumferential end portion 60 and a hollow contact end portion 62 containing a central aperture 64 therein. Threaded circumferential end portion 60 is adapted to be threaded onto the threaded end section 54 of main body 52. Other embodiments of the invention include a cap and housing with reversed threading arrangements. That is, other embodiments provide a cap having external threads to be mated with an end of a cap having internal, female threads. For clarity in the present discussion, however, only the illustrated embodiment will be described.

A retractable metal plunger 66 having a contact element 68 integrally-formed with a flanged base 70 is slidingly-situated in cap 58 such that contact element 68 extends through and out of central aperture 64. The contact element is a cylindrical, hollow metal structure closed on the contact end. A plunger retention means in the form of a circumferential retaining bead 72 is integrally formed on an inner surface of cap 58 at the point where hollow contact end portion 62 interfaces with threaded circumferential end portion 60. Retaining bead 72 limits the movement of plunger 66 within cap 58 and prevents plunger 66 from falling out of cap 58, as will be soon be described.

In operation, the adapter is inserted into a car cigarette lighter. Plunger 66 engages the lighter element connected to the car battery and retracts in the direction A shown in FIG. 3. Flanged base 70 engages spring-biased fuse 56 and pushes fuse 56 into active engagement with an electrical connector of the power cord of the adapter assembly, thus providing power to the cell phone. Plunger 66 does not engage against retaining bead 72 at this time. Those of ordinary skill will appreciate that different arrangements of the spring, the fuse and the plunger might be provided. For example, the assembly might reverse the spring and the fuse in relation to the plunger and either the fuse or the spring, depending on the assembly chosen, might slide within the hollow opening of the plunger. Variations of this sort do not impact upon the implementation of preferred aspects of the present invention and so are not described further herein.

When cap 58 is unthreaded from the main body 52 of the housing to check or replace the fuse 56, retaining bead 72 prevents plunger 66, loosely-retained in cap 58, from falling out of the cap and getting lost, which would otherwise occur. While the described preferred embodiment uses a circumferential bead to retain the plunger within the cap, other retaining structures might be used. For example, an asymmetric bead might be used or another broken bead configuration might be used. Such a broken bead configuration might consist of one, two, three or more protrusions extending inwardly from the inner surface of the cap in a manner that retains the plunger in place. Variations on the retaining bead structure are apparent. The most preferred of these are capable of being formed, with the plunger in its place within the cap, in the same simple manner used in forming the circumferential bead, described below.

Applicant has ascertained that a cigarette lighter adapter constructed in accordance with the present invention and incorporating the plunger retention means described above suffers the potential that, if the adapter is accidentally dropped and the contact end of the plunger hits a hard surface, the force transmitted through the retracting plunger can damage or break the plunger prevention means. Accordingly, it is a further aim of the instant invention to prevent the possibility of such an accidental event.

Figure 4:
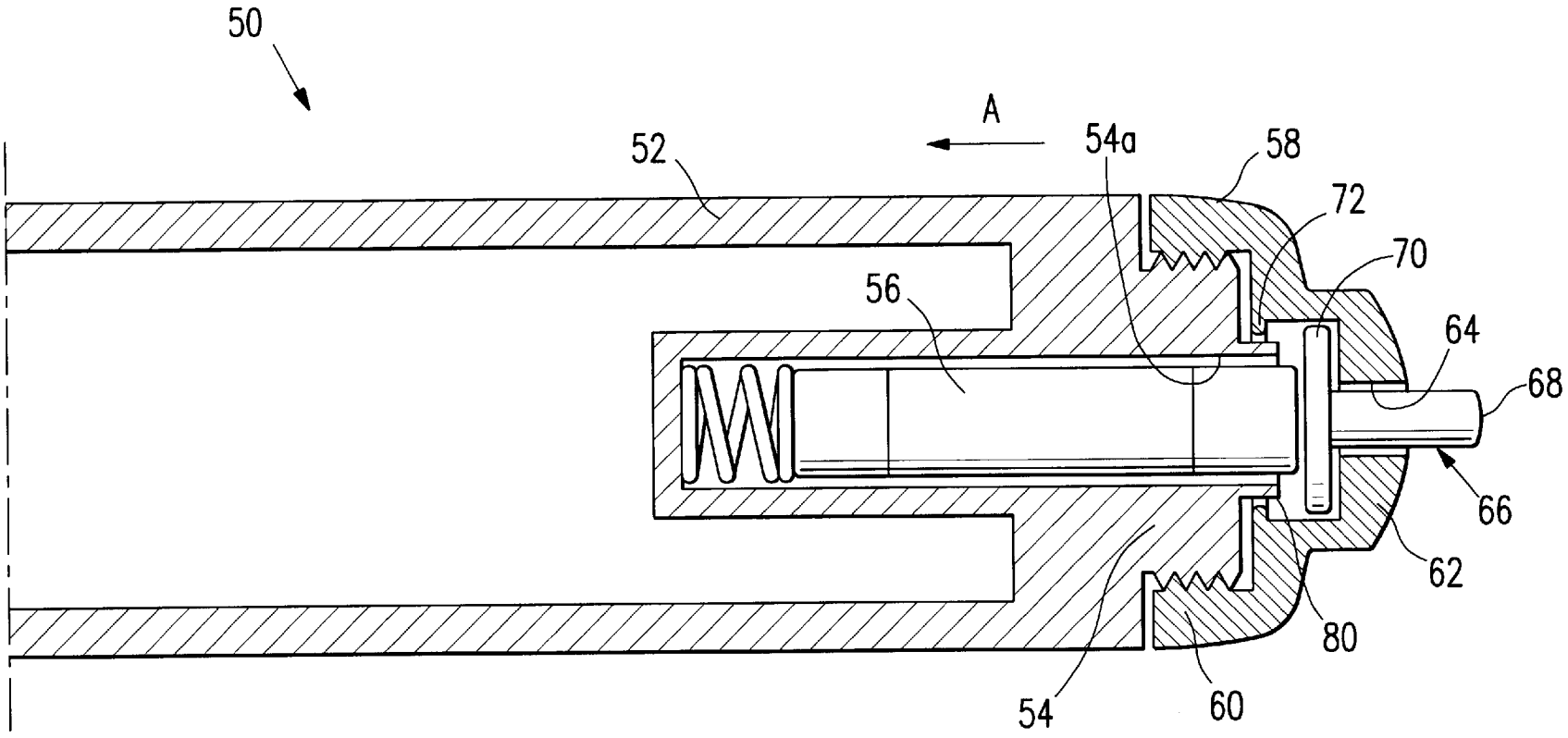
FIG. 4 is a cross-sectional view of a second embodiment of a cigarette lighter adapter in accordance with the present invention.

FIG. 4 illustrates another embodiment and preferred aspect of the present invention which obviates the problem just described. In FIG. 4, like numerals indicate elements similar to or identical to those shown in the FIG. 3 embodiment.

As shown in FIG. 4, a cigarette lighter adapter similar to that shown in FIG. 3 is additionally provided with means for preventing force from being applied to the plunger retention means by the plunger. Specifically, a backing means 80, composed here of a circumferential backing tube or ring, is integrally provided adjacent aperture 54*a* on the end face of threaded end section 54, and extends therefrom. The diameter of the circumferential ring 80 is slightly smaller than the diameter of the retaining bead 72 formed in cap 58. Accordingly, when cap 58 is threaded onto threaded end section 54, circumferential ring 80 extends beyond retaining bead 72 into the hollow interior of cap 58. Operation of the cigarette lighter adapter requires that the fuse easily pass through the center of the circumferential ring 80 to make good contact with the plunger. Thus, the inner diameter of the circumferential ring 80 should be larger than the diameter of the fuse and the outer diameter of the circumferential ring 80 should be smaller than the inner diameter of the retaining bead 72. Of course, this arrangement is easily met in those embodiments (not illustrated) in which either the fuse or the spring are provided with sufficiently small diameters as to slide within a hollow cylindrical interior of the plunger.

According to the embodiment of the invention illustrated in FIG. 4, let us assume that the cigarette lighter adapter assembly is accidentally dropped, as often happens with such assemblies, and a significant force inadvertently applied to plunger 66, e.g., plunger contact end 68 hits the floor or pavement. In the event of such an accident, plunger 66 retracts towards and into contact with force-preventing means 80 and the inadvertently-applied force is absorbed thereby, thus protecting the relatively-fragile retaining bead 72 from being broken by the sizeable force which would otherwise impact upon it.

The adapter of the present invention can be manufactured using techniques well known in the art. Thus, the main body and cap of the adapter housing can be made of diverse known thermoplastics using conventional thermoplastic molding techniques, such as injection molding. The plunger retention means, exemplified in the preferred embodiments as a retaining bead, can be formed integrally with the housing using well-known force pressing, sonic welding, or heat fixture processes. In this regard, for example, the retaining bead can be formed on the cap means of the same thermoplastic material as the housing by reflowing plastic using sonic welding employing ultrasonic vibration at 20

Khz up to greater than 40 KHz, with 40 Khz representing a particularly useful operating point. The force-absorbing means, exemplified in the preferred embodiments as a backing tube or ring, can likewise be formed of the same thermoplastic material as the adapter housing using similar standard techniques to those used in forming the housing, such as injection molding.

Various modifications and alternatives will be apparent to those of ordinary skill in the art. For example, while the main body and the cap means of the illustrated embodiments are removably-connected by threaded end sections, it is clear that these two housing elements can be mated in any known manner, such as by snap-on connections, without affecting the scope and practice of the invention. Likewise, the overall shape of the cigarette lighter adapter housing is not critical and can vary widely, so long as the cap means of the housing is designed for insertion into active engagement with a cigarette lighter socket, in the manner well-known in the art.

We claim:

1. A cigarette lighter adapter for use in a cigarette lighter adapter assembly, comprising:

a housing including a main body for holding a removable fuse and an apertured cap removably-secured to the main body;

a retractable metal plunger arranged in and extending from the apertured cap for interconnecting the fuse and a car battery power source when the cigarette lighter adapter is engaged with a car cigarette lighter;

plunger retention means in the apertured cap for retaining the metal plunger in the apertured cap when the apertured cap is removed from the main body;

wherein the retractable metal plunger comprises a contact element integrally connected to a flanged base, the apertured cap is hollow and comprises a contact end portion integrally connected to a threaded end portion, and the plunger retention means comprises a circumferential retaining bead integrally formed on an inner surface of the apertured cap at an interface between the contact end portion and threaded end portion thereof.

2. The cigarette lighter adapter according to claim 1, further comprising force-absorbing means arranged on an end surface of the main body for preventing force from being applied to the plunger retention means by the metal plunger.

3. The cigarette lighter adapter according to claim 2, wherein the force-absorbing means comprises a circumferential backing ring integrally formed on the housing end surface and extending into the apertured cap beyond the plunger retention means when the adapter is assembled, to prevent the plunger means from contacting the plunger retention means and transmitting force thereto.

4. The cigarette lighter adapter according to claim 3, wherein the retaining bead and the circumferential backing ring are plastic.

5. The cigarette lighter adapter according to claim 1, wherein the housing is injection-molded plastic.

* * * * *